US005232381A

United States Patent [19]

Yu

[11] Patent Number: 5,232,381

[45] Date of Patent: Aug. 3, 1993

[54] MULTI-WAY MULTIPLE PLUG

[76] Inventor: Tsung-I Yu, No. 4, Aly. 2, Ln. 23, Sec. 3, Pateh Road, Pan-Chiao City, Taiwan

[21] Appl. No.: 925,119

[22] Filed: Aug. 6, 1992

[51] Int. Cl.[5] ..... H01R 25/00

[52] U.S. Cl. ..... 439/652; 439/655

[58] Field of Search ..... 439/638–655, 439/501, 502, 744–747, 871, 872, 217–221

[56] References Cited

U.S. PATENT DOCUMENTS

| | | | |
|---|---|---|---|
| 2,792,561 | 5/1957 | Cohen | 439/652 |
| 3,036,288 | 5/1962 | Taylor | 439/652 |
| 3,920,308 | 11/1975 | Murray | 439/501 |
| 4,390,231 | 6/1983 | Plyler et al. | 439/872 |
| 5,071,367 | 12/1991 | Luu | 439/502 |
| 5,122,082 | 6/1992 | Lee | 439/652 |
| 5,138,351 | 8/1992 | Wiegand et al. | 439/501 |

*Primary Examiner*—David L. Pirlot

*Attorney, Agent, or Firm*—Jacobson, Price, Holman & Stern

[57] ABSTRACT

A multi-way multiple plug comprises a socket seat portion defined by a housing inside which at least a hot plate and a neutral plate are disposed. A plurality of outlet slot pairs are formed on at two opposite surfaces of the housing in association with the hot plate and the neutral plate to allow a number of external plugs to be simultaneously inserted into the outlet slot pairs from both surfaces to form electrical connections with the hot plate and the neutral plate. A plug portion which comprises a seat with at least a hot blade and a neutral blade secured thereon is mounted to the housing. Both the hot blade and the neutral blade have a snap-on type ratchet device to be firmly held by a support formed on the seat.

10 Claims, 8 Drawing Sheets

MULTI-WAY MULTIPLE PLUG

FIELD OF THE INVENTION

The present invention relates generally to a multiple plug and in particular to one having a plurality of outlet slot pairs formed thereon

BACKGROUND OF THE INVENTION

A multiple plug usually has a plug portion for plugging into a main power wall outlet and a plurality of outlet slot pairs for receiving therein a plurality of electric appliance plugs in order to expand and convert a wall outlet to a plurality of extension power outlets. A conventional multiple plug is a three-way multiple plug which cannot receive more than three external plugs and thus has only limited usage. To connect more plugs to a single wall outlet, an extension cord which has a socket seat with a plurality of sockets formed thereon may be used. The extension cord is primary for a remote power supply which, although not being designed for expansion of the number of plugs to be connected to a wall outlet, may also be used as means of such purpose. A disadvantage is that an extension cord, as the name suggests, has a long electric wire which generally interferes the movement of a user when it is used as an outlet expansion means.

It is therefore desirable to have a multi-way multiple plug which has a plurality of outlet slot pairs for receiving therein a plurality of external plugs.

Further, the socket seat of a conventional extension cord set has sockets formed on one surface thereof only, usually disposed in a line, so that the socket is usually in the form of an elongated rectangle to accommodate more sockets. The more sockets it accommodates, the longer the socket seat is. This apparently requires a larger space for the disposition of the socket seat of a conventional extension cord set. It is therefore also required to provide a socket seat structure which has sockets formed on two opposite surfaces thereof to accommodates more sockets in a given length of the socket seat.

OBJECTS OF THE INVENTION

It is therefore a primary object of the present invention to provide a multi-way multiple plug which has a plurality of outlet sockets for receiving therein a plurality of external plugs.

It is a subsidiary object of the present invention to provide an improved socket seat structure which has a plurality of sockets formed on two opposite surfaces thereof to accommodate more sockets for a given size of the socket seat.

It is another subsidiary object of the present invention to provide an improved plug structure of which the two blades and the grounding prong are secured on a seat with a snap-on type ratchet device so as to be firmly fixed on the seat.

To achieve the above-mentioned object, there is provided a multi-way multiple plug comprising a socket seat portion defined by a housing inside which at least a hot plate and a neutral plate are disposed. A plurality of outlet slot pairs are formed on at two opposite surfaces of the housing in association with the hot plate and the neutral plate to allow a number of external plugs to be simultaneously inserted into the outlet slot pairs from both surfaces to form electrical connections with the hot plate and the neutral plate. A plug portion which comprises a seat with at least a hot blade and a neutral blade secured thereon is mounted to the housing. Both the hot blade and the neutral blade have a snap-on type ratchet device to be firmly held by a support formed on the seat.

Other objects and advantages of the invention will be apparent from the following description of preferred embodiments taken in connection with the accompanying drawings, in which:

DETAILED DESCRIPTION OF THE PREFERRED EMBODIMENTS

Figure 1:
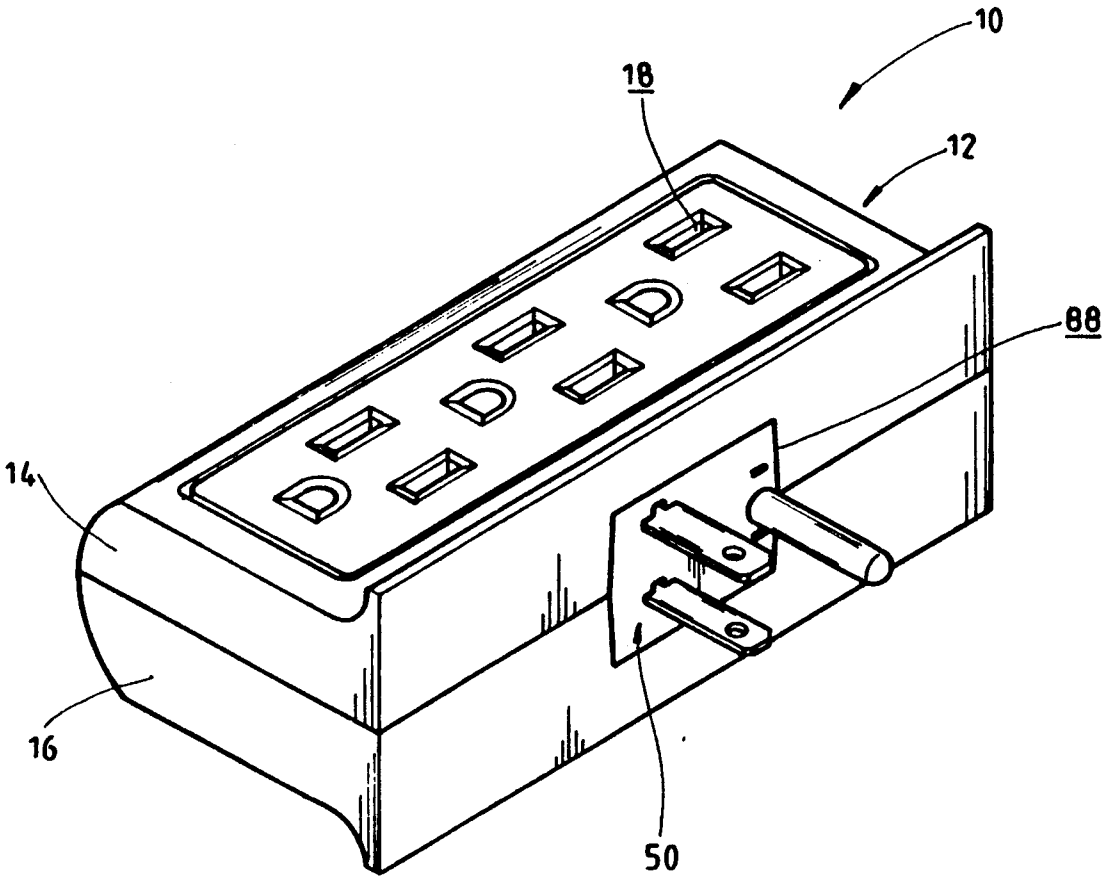
FIG. 1 is a perspective view of a multi-way multiple plug in accordance with the present invention
Figure 2:
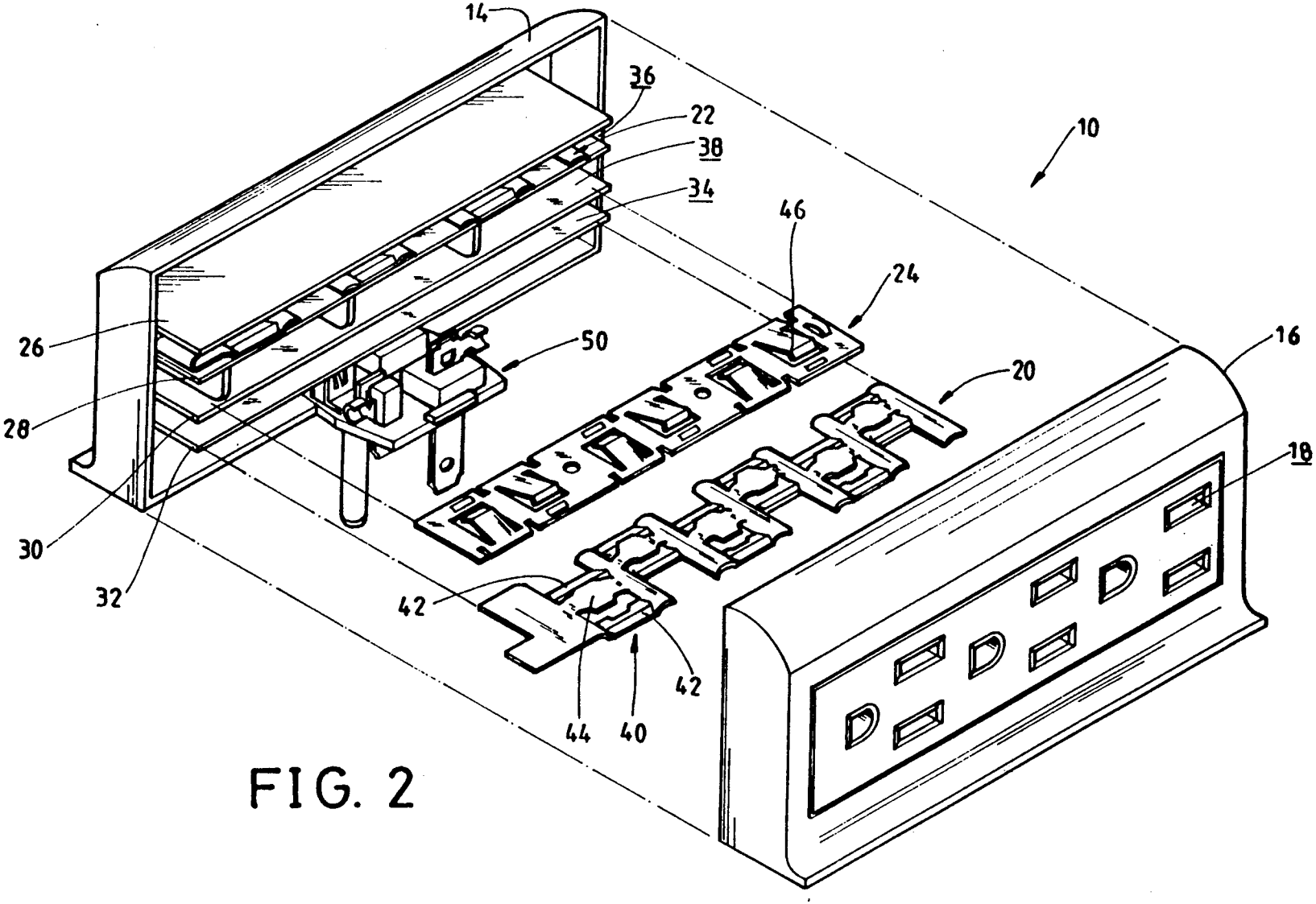
FIG. 2 is an exploded fragmentary view of the multi-way multiple plug shown in FIG. 1.
Figure 3:
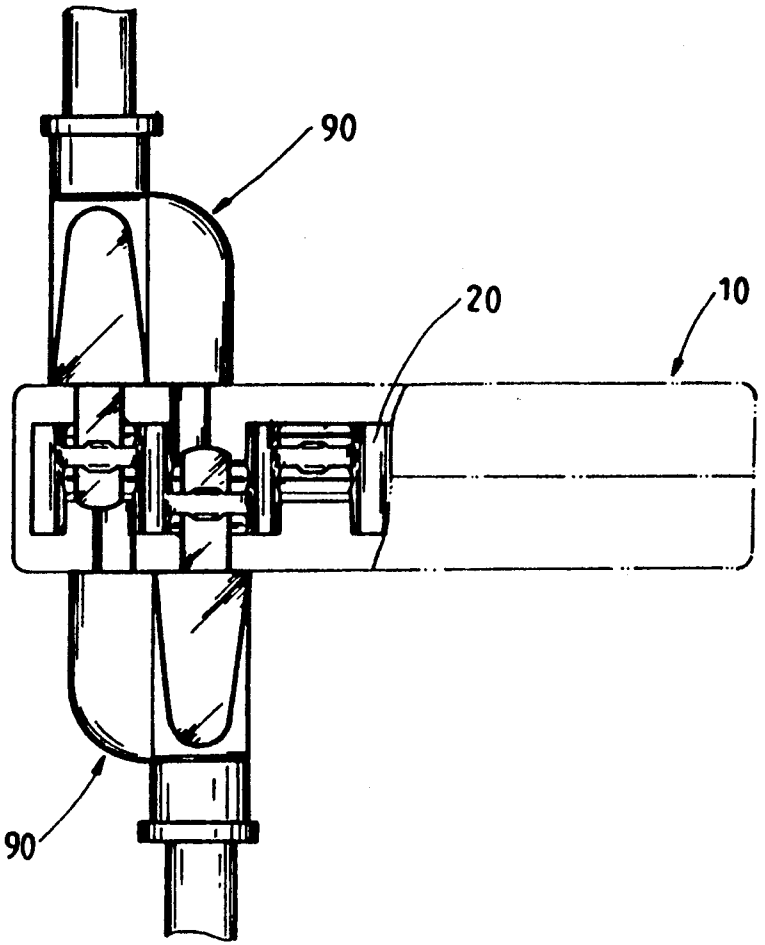
FIG. 3 is a part sectional side elevational view of the multi-way multiple plug with two external plugs penetrating into the outlet slots thereof.
Figure 4:
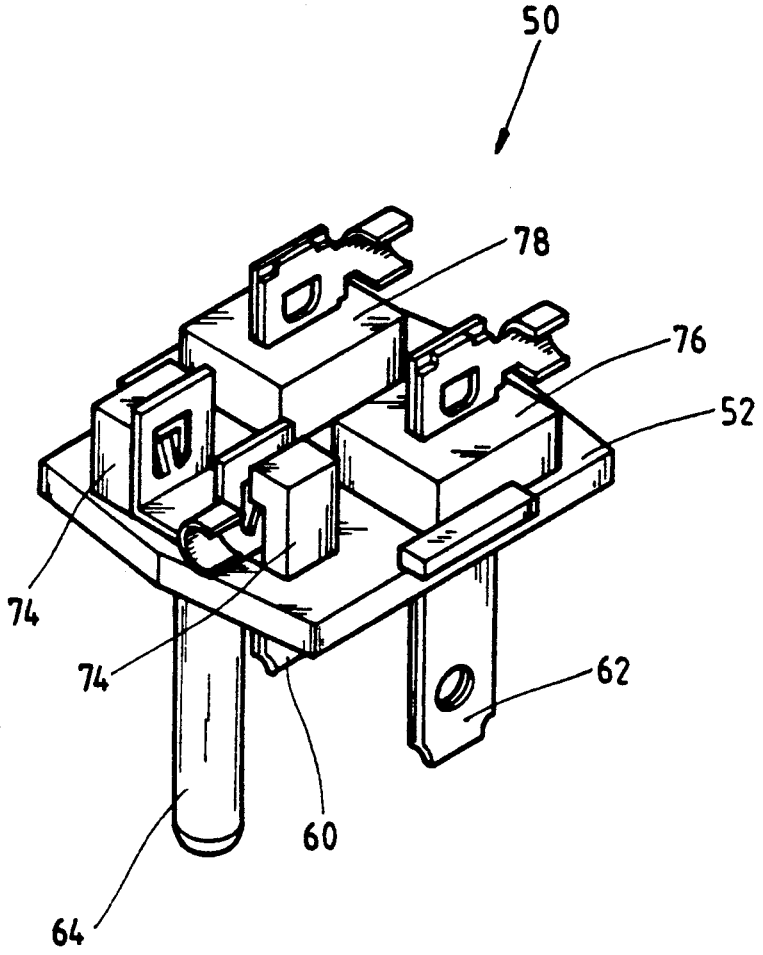
FIG. 4 is a perspective view showing the structure of the plug portion of the multi-way multiple plug in accordance with the present invention.
Figure 5:
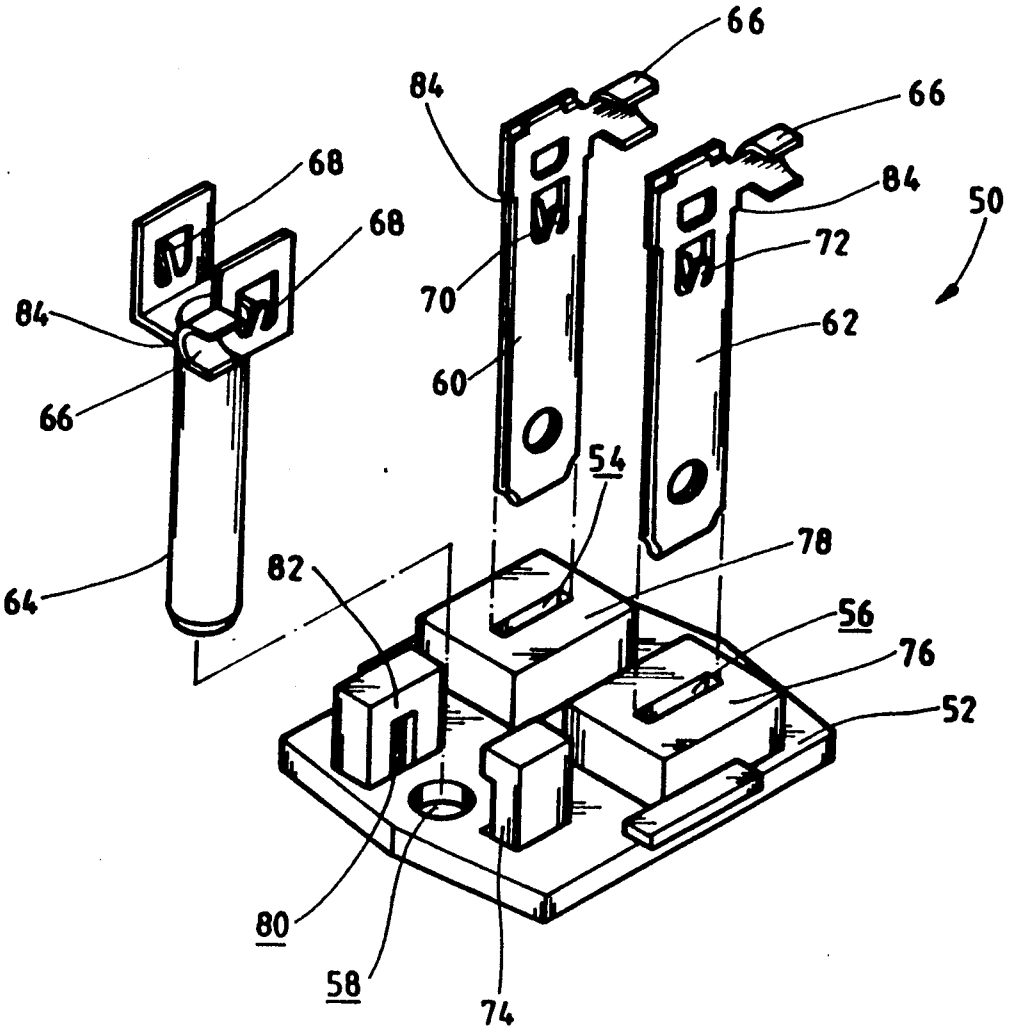
FIG. 5 is an exploded fragmentary view of the plug portion shown in FIG. 4.

Referring to the drawings and in particular to FIGS. 1, 2 and 3, a multi-way multiple plug in accordance with the present invention, generally designated with the reference numeral 10, is shown. The multi-way multiple plug 10 comprises a housing 12 defined by a first casing member 14 and a second casing member 16. The casing members 14 and 16 are substantially rectangular in shape. Each of the casing members 14 or 16 has a plurality of outlet slot pairs 18 disposed in a line along the length of the casing members 14 and 16. The term "outlet slot pair", as used herein, refers to the outlet slots that generally form an outlet socket which may comprise a pair of slots, one for a neutral line and the other for a hot line and in many cases further comprising a ground hole for a grounding line.

To avoid interference between an external plug (not shown) inserted from the first casing member 14 and that inserted from the second casing member 16, the outlet slot pairs 18 of the first casing member 14 and those of the second casing member 16 are disposed in an alternate way. In other words, the outlet slot pairs 18 on the second casing member 16 are respectively disposed on the spaces between two successive outlet slot pairs 18 on the first casing member 14 when viewed in a direction normal to the lengths of the casing members 14 and 16.

The housing 12 defines an interior space inside which a hot plate 20 and a neutral plate 22 extending substantially along the length of the casing members 14 and 16 with a ground plate 24 inbetween are disposed. All the three plates 20, 22 and 24 are made of a conductive material, such as cooper plates. To hold the three conductive plates 20, 22 and 24 in position, a plurality of guiding plates 26, 28, 30 and 32 are secured on an inside surface of one of the casing members, for example member 14 as shown in the drawings, to form three parallel slots 34, 36 and 38 extending substantially along the length of the casing members 14 and 16 to respectively receive therein the three plates 20, 22 and 24.

The hot plate 20 is constituted by a plurality of segments, each of which forms a blade engaging means 40. The number of the blade engaging means 40 is equal to the sum of the outlet slot pairs 18 of both the first casing member 14 and the second casing member 16. Each of the blade engaging means 40 comprises two side panels 42 with a middle panel 44 inbetween. The middle panel 44 is offset with respect to the side panels 42 in a direction normal to a surface of the hot plate 20 so as to form a space between the side panels 42 and the middle panel 44 when viewed from a direction normal to both the length of the casing members 14 and 16 and the direction along which the middle panel 44 is offset. The space serves to receive the hot blade of an external plug (not shown) therein when the external plug is inserted into the multi-way multiple plug of the present invention.

The side panels 42 and the middle panel of each of the blade engaging means 40 are slightly bent to provide a resilient contact between these panels and the blade inserted therein.

Since the outlet slot pairs 18 of both the first and the second casing members 14 and 16 are disposed alternately, the blade engaging means 40 of the hot plate 20 are also disposed in an alternate way, namely, for example, the blade engaging means 40 of odd number are formed on a first lateral edge which extends along the length of the casing members 14 and 16 while the blade engaging means 40 of even number are formed on a second lateral edge which is opposite to the first lateral edge.

The neutral plate 22 has a structure similar to that of the hot plate 20 just described above and will not be further described.

The ground plate 24 has a plurality of inclined panels 46 in correspondence with the locations of the grounding holes of the outlet slot pairs 18 of both the first and the second casing members 14 and 16 to provide a resilient contact with the grounding prong of an external plug inserted therein. The inclined panels 46 are also formed in an alternate way for mating the grounding prongs which may be inserted from either of the first and the second casing members 14 and 16.

With the arrangement just described, it is understood that the multi-way multiple plug 10 of the present invention provides a socket seat which can receive a plurality of external plugs from either side thereof. It is understood to those skilled in the art that such a structure for receiving external plugs from both sides can be applied to the socket seat of an extension cord set which heretofore can receives external plugs from only one side thereof.

In accordance with another aspect of the present invention, the multi-way multiple plug 10 comprises a plug portion 50 as best seen in FIGS. 4–7. The plug portion 50 comprises a seat 52 on which three through holes 54, 56 and 58 are formed. The through holes 54, 56 and 48 are respectively complemental in cross-sectional shape and size to a hot blade 60, a neutral blade 62 and a grounding prong 64 in that order. Each of the hot blade 60, the neutral blade 62 and the grounding prong 64 has a wire connection member 66 in the form of a U shape to receive an end of a naked wire therein and clamp the wire end by being pinched with a plier (not shown) or the like.

Each of the hot blade 60, the neutral blade 62 and the grounding prong 64 has a first end which protrudes out of the seat 52 through the associated through holes 54, 56 or 58 and a second end on which the wire connection member 66 is formed or mounted. Each of the hot blade 60, the neutral blade 62 and the grounding prong 64 has a pair of retaining legs 68, 70 or 72 formed in the proximity of the second end thereof. The retaining legs 68, 70 or 72 are oppositely bent laterally to form an outward-inclined pair toward the second end of the blade 60 or 62 or the prong 64.

Figure 6:
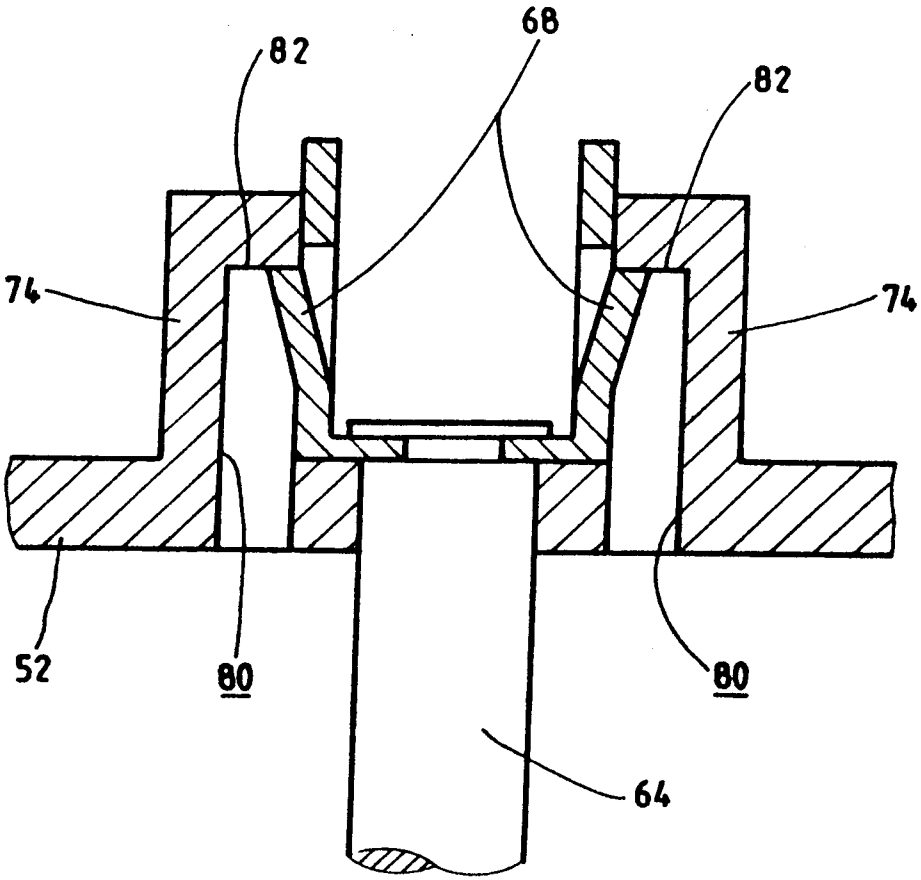
FIG. 6 is a part cross-sectional view showing the securing of the grounding prong of the plug portion shown in FIG. 4.
Figure 7:
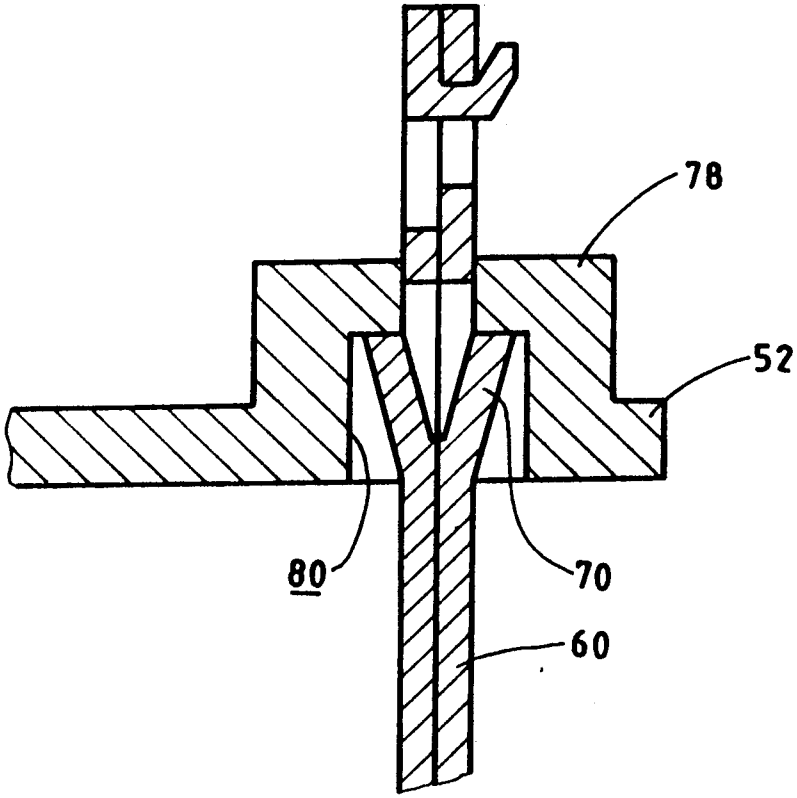
FIG. 7 is a part cross-sectional view showing the securing of one of the conductive blades of the plug portion shown in FIG. 4.

Formed on the seat 52 in correspondence with the outward-inclined pairs of retaining legs 68, 70 and 72 are a plurality of retaining supports 74, 76 and 78. The retaining supports may be formed as a single piece fixed on the seat 52 with the through hole formed thereon and extending to the seat 52, such as the retaining supports 76 and 78, or they may be formed as a pair of opposing pieces, such as the retaining support 74. In either cases, there are two opposing grooves 80 respectively formed in two opposing inside surfaces of the through hole of each of the retaining supports 74, 76 or 78 to slidably receive therein the retaining legs 68, 70 or 72. The engagement between the grooves 80 and the retaining legs 68, 70 and 72 are best seen in FIGS. 6 and 7.

Each of the grooves 80 has a stop end 82 which serves to stop a backward movement of the retaining legs 68, 70 and 72 so as to keep the retaining legs 68, 70 and 72 and thus the hot blade 60, the neutral blade 72 and the grounding prong 64 securely held on the seat 52. At least a shoulder portion 84 is formed on each of the hot blade 60, the neutral blade 62 and the grounding prong 64 to prevent these members from being moved forward and thus in this manner the hot blade 60, the neutral 62 and the grounding prong 64 are secured on the seat without moving in any direction.

Turning now back to FIG. 1, it can be seen that a notch 88 is formed on a surface of each of the first casing member 14 and second casing member 16 in such a way that when the casing members 14 and 16 are secured together to form the housing 12, a recess is formed with the size and shape thereof substantially complementary to the seat 52 and thus the seat 52 is disposable therein to partly constitute the housing 12

Figure 8:
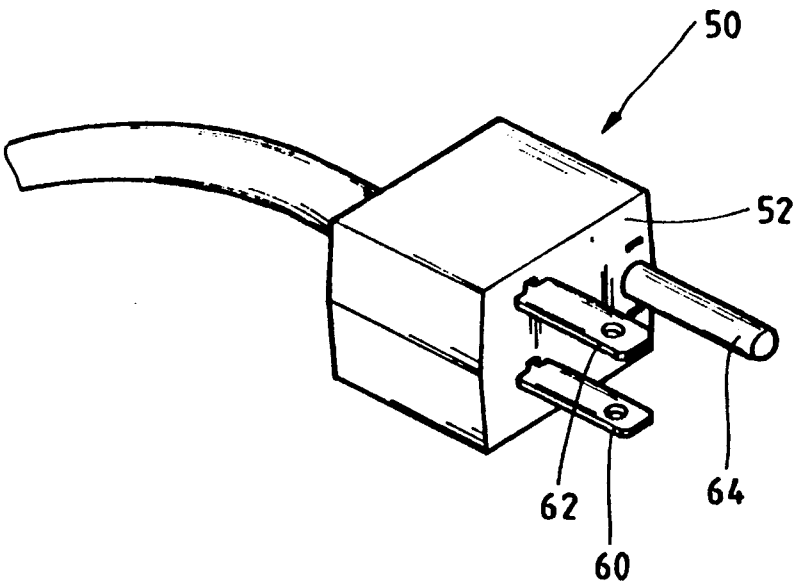
FIG. 8 is a perspective view showing another way embodying the plug portion shown in FIG. 4.

It is apparent that although the invention has been described in connection with a preferred embodiment, those skilled in the art may make changes to certain features of the preferred embodiment without departing from the spirit and scope of the invention as defined in the appended claims. Such changes may include using the plug portion of the device of the present invention as an individual plug of any electrical appliance or extension cord set, such as that shown in FIG. 8. It is also understood that if the plug portion is manufactured as an individual plug with an extension wire connected between the plug portion and the socket seat portion of the present invention, then the present invention can also serve as an extension cord set.

What is claimed is:

1. A multi-way multiple plug comprising a socket seat portion with a plug portion mounted thereon, said socket seat portion comprising:

a housing defined by a first casing member and a second casing member inside which an interior space is formed, the first and second casing members defining first and second opposite facing surfaces, respectively, the first casing member having a first plurality of outlet slot pairs formed on its surface, and the second casing member having a second plurality outlet slot pairs, each of the outlet slot pairs comprising at least a slot for a hot line and a slot for a neutral line, the first plurality of outlet slot pairs and the second plurality of outlet slot pairs being alternatively disposed on said opposite surfaces of the housing so that not outlet slot pair in said first plurality is directly opposite an outlet slot pair in said second plurality, said housing further comprising a recess; and a single hot plate and a single neutral plate, which are disposed and secured inside said interior space of the housing in correspondence with said hot line slots and said neutral line slots, the hot plate and neutral plate for making electrical contact with an appropriate blade of an external plug which is inserted into any one of said outlet slot pairs; and said plug portion comprising:

a seat which is substantially complementary to the recess for fitting into said recess, the seat having a plurality of conductive blades, including at least a hot blade and a neutral blade, secured thereon with a securing means and for making electrical connection with said hot plate and said neutral plate, respectively, in said housing.

2. A multi-way multiple plug as claimed in claim 1 wherein each of said hot plate and said neutral plate comprises a plurality of segments, each of which forms a blade engaging means corresponding to each of said outlet slot pairs, each of the blade engaging means comprising two side panels with a middle panel inbetween, the middle panel being offset with respect to the side panels in a direction normal to a surface of said hot plate so as to form a blade receiving space between the side panels and the middle panel when viewed from a direction normal to the direction along which the middle panel is offset.

3. A multi-way multiple plug as claimed in claim 1 wherein said securing means of the plug portion comprises a plurality of retaining supports secured on said seat, each having a through slot extending therethrough to respectively receive therein one of said conductive blades, a pair of opposing grooves being formed inside each of said through slots to slidably receive therein a pair of outward-bent resilient retaining legs formed in an opposing way on each of said conductive blades, each of said grooves having a stop end to prevent the retaining leg associated therewith from being moved in a first direction and each of said conductive blades having at least a shoulder also serving as a stop to prevent said retaining leg from being moved in a second direction opposite to said first direction.

4. A multi-way multiple plug as claimed in claim 3, and further comprising a ground plate disposed in the interior space of the housing and wherein each of said outlet slot pairs further comprises a grounding slot and wherein said conductive blades of the plug portion further comprise a grounding prong.

5. A multi-way multiple plug as claimed in claim 4 wherein said ground plate comprises a plurality of resilient contacts in correspondence with each of the grounding holes to provide a resilient contact with a grounding prong of each external plug.

6. An extension cord set comprising a plug portion electrically connected to a socket seat portion with an extension wire, said socket seat portion comprising:

a housing defined by a first casing member and a second casing member inside which an interior space is formed, the first and second casing members defining first and second opposite facing surfaces, respectively, the first casing member having a first plurality of outlet slot pairs formed on its surface and the second casing member having a second plurality outlet slot pairs, each of the outlet slot pairs comprising at least a slot for a hot line and a slot for a neutral line, the first plurality of outlet slot pairs and the second plurality of outlet slot pairs being alternatively disposed on said opposite surfaces of the housing so that no outlet slot pair in said first plurality is directly opposite an output pair in said second plurality, said extension wire passing through said housing to establish electrical connection between said plug portion and said socket seat portion; and a single hot plate and a single neutral plate, which are disposed and secured inside said interior space of the housing in correspondence with said hot line slots and said neutral line slots each for making electrical contact with an appropriate blade of an external plug which is inserted into said outlet slot pairs; and said plug portion comprising:

a seat which has a plurality of conductive blades, including at least a hot blade and a neutral blade, secured thereon with a securing means, said blades for making electrical connection with said extension wire to said conductive plates of said socket seat portion.

7. An extension cord set as claimed in claim 6 wherein each of said hot plate and said neutral plate comprises a plurality of segments, each of which forms a blade engaging means corresponding to each of said outlet slot pairs, each of the blade engaging means comprising two side panels with a middle panel inbetween, the middle panel being offset with respect to the side panels in a direction normal to a surface of said hot plate so as to form a blade receiving space between the side panels and the middle panel when viewed from a direction normal to the direction along which the middle panel is offset.

8. An extension cord set as claimed in claim 6 wherein said securing means of the plug portion comprises a plurality of retaining supports secured on said seat, each having a through slot extending therethrough to respectively receive therein one of said conductive blades, a pair of opposing grooves being formed inside each of said through slots to slidably receive therein a pair of outward-bent resilient retaining legs formed in an opposing way on each of said conductive blades, each of said grooves having a stop end to prevent the retaining leg associated therewith from being moved in a first direction and each of said conductive blades having at least a shoulder also serving as a stop to prevent said retaining leg from being moved in a second direction opposite to said first direction.

9. An extension cord set as claimed in claim 8, and further comprising a ground plate disposed in the interior space of the housing and wherein each of said outlet slot pairs further comprises a grounding slot and wherein said conductive blades of the plug portion further comprise a grounding prong.

10. An extension cord as claimed in claim 9 wherein said ground plate comprises a plurality of resilient contacts in correspondence with each of the grounding holes to provide a resilient contact with a grounding prong of each external plug.

* * * * *